US009574503B2

(12) United States Patent
Sato et al.

(10) Patent No.: US 9,574,503 B2
(45) Date of Patent: Feb. 21, 2017

(54) ENGINE AND OUTBOARD MOTOR

(71) Applicant: YAMAHA HATSUDOKI KABUSHIKI KAISHA, Iwata-shi, Shizuoka (JP)

(72) Inventors: Tomoaki Sato, Shizuoka (JP); Takuya Kado, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 105 days.

(21) Appl. No.: 14/174,141

(22) Filed: Feb. 6, 2014

(65) Prior Publication Data

US 2014/0238339 A1 Aug. 28, 2014

(30) Foreign Application Priority Data

Feb. 25, 2013 (JP) ..... 2013-035065

(51) Int. Cl.
*F02D 1/02* (2006.01)
*F02D 17/04* (2006.01)
*F02D 9/02* (2006.01)

(52) U.S. Cl.
CPC ..... *F02D 17/04* (2013.01); *F02D 1/025* (2013.01); *F02D 2009/0245* (2013.01)

(58) Field of Classification Search
CPC ..... F02D 2001/0075; F02D 1/025; F02D 2001/167;F02D 2009/0223; F02D 35/025; F02D 2200/021; F02D 17/04
See application file for complete search history.

(56) References Cited

U.S. PATENT DOCUMENTS 5,669,349 A * 9/1997 Iwata et al. ..... 123/335
2002/0088429 A1 7/2002 Morikami
2004/0245034 A1* 12/2004 Miyamoto et al. ..... 180/170

FOREIGN PATENT DOCUMENTS

JP 10-103134 A 4/1998
JP 11-72040 A 3/1999

* cited by examiner

*Primary Examiner* — Jacob Amick
(74) *Attorney, Agent, or Firm* — Keating and Bennett, LLP

(57) ABSTRACT

An engine includes a catalyst disposed inside an exhaust passage that guides exhaust discharged from a combustion chamber and a controller programmed to control a throttle valve and a fuel injector. If the engine is overheating, the controller is programmed to control the opening degree of the throttle valve or the injection amount of fuel from the fuel injector to decrease the rotational speed of the crankshaft and to control the injection amount of fuel from the fuel injector to set a target air-fuel ratio to a value richer than a stoichiometric air-fuel ratio.

17 Claims, 9 Drawing Sheets

M1

| DEFAULT | ENGINE SPEED (rpm) | | | | | | |
|---|---|---|---|---|---|---|---|
| | 500 | 1000 | 2000 | 3000 | 4000 | 5000 | 6000 | 6300 |
| INTAKE PRESSURE (kPa) | | | | | | | | |
| 20 | λ3 | λ3 | λ3 | λ3 | λ3 | λ3 | λ3 | λ3 |
| 30 | λ3 | λ2 | λ2 | λ2 | λ2 | λ3 | λ3 | λ3 |
| 40 | λ3 | λ1 | λ1 | λ2 | λ2 | λ2 | λ2 | λ2 |
| 50 | λ3 | λ1 | λ1 | λ1 | λ1 | λ2 | λ2 | λ2 |
| 60 | λ3 | λ1 | λ1 | λ1 | λ1 | λ1 | λ1 | λ1 |
| 70 | λ3 | λ2 | λ1 | λ1 | λ1 | λ1 | λ1 | λ1 |
| 80 | λ3 | λ2 | λ2 | λ2 | λ1 | λ1 | λ1 | λ1 |
| 90 | λ3 | λ2 | λ2 | λ2 | λ2 | λ1 | λ1 | λ1 |
| 100 | λ3 | λ2 | λ2 | λ2 | λ2 | λ2 | λ1 | λ1 |

| FOR OH | ENGINE SPEED (rpm) | | | | | | | |
|---|---|---|---|---|---|---|---|---|
| | 500 | 1000 | 2000 | 3000 | 4000 | 5000 | 6000 | 6300 |
| INTAKE PRESSURE (kPa) | | | | | | | | |
| 20 | λ6 | λ6 | λ6 | λ6 | λ6 | λ6 | λ6 | λ6 |
| 30 | λ6 | λ5 | λ5 | λ5 | λ5 | λ6 | λ6 | λ6 |
| 40 | λ6 | λ4 | λ4 | λ5 | λ5 | λ5 | λ5 | λ5 |
| 50 | λ6 | λ4 | λ4 | λ4 | λ4 | λ5 | λ5 | λ5 |
| 60 | λ6 | λ4 | λ4 | λ4 | λ4 | λ4 | λ4 | λ4 |
| 70 | λ6 | λ5 | λ4 | λ4 | λ4 | λ4 | λ4 | λ4 |
| 80 | λ6 | λ5 | λ5 | λ5 | λ4 | λ4 | λ4 | λ4 |
| 90 | λ6 | λ5 | λ5 | λ5 | λ5 | λ4 | λ4 | λ4 |
| 100 | λ6 | λ5 | λ5 | λ5 | λ5 | λ5 | λ4 | λ4 |

ENGINE AND OUTBOARD MOTOR

BACKGROUND OF THE INVENTION

1. Field of the Invention

The present invention relates to an engine including a catalyst that purifies exhaust and to an outboard motor powered by the engine.

2. Description of the Related Art

With a vessel, even if engine overheating occurs, the engine is not stopped and the operation of the engine is continued in a state of restricted engine speed to return the vessel to port. With the outboard motor disclosed in Japanese Unexamined Patent Publication No. H11-72040, the engine speed is decreased by misfiring when the engine overheats. With the outboard motor described in U.S. Patent Application Publication No. 2002/0088429 A1, the engine speed is decreased by at least one of misfiring and stopping the fuel supply when the engine overheats.

When the engine output is decreased to decrease the engine speed, the amount of heat generated by the engine decreases and, therefore, the temperature rise rate of the engine decreases gradually and the temperature of the engine begins to decrease. However, as shall be described below, if the amount of heat generated by the engine is large, the temperature of the engine continues to rise even when the engine speed is decreased.

For example, with an engine that includes a catalyst, not only combustion heat but heat due to reaction of the catalyst and exhaust is also generated. Further with the engine that includes the catalyst, an air-fuel ratio (A/F) of an air-fuel mixture is set at a stoichiometric air-fuel ratio (air-fuel ratio at which the oxygen and the fuel in the air-fuel mixture react in just proportions) in many operation conditions and, therefore, the temperature of the exhaust is high. There is thus a possibility that the temperature rise rate of the engine cannot be decreased rapidly by simply decreasing the engine speed. Further with the conventional outboard motors mentioned above, exhaust containing uncombusted fuel is discharged from the combustion chamber because the engine speed is decreased by misfiring. Therefore, if a catalyst is installed in the engine, the exhaust containing the uncombusted fuel contacts the catalyst and accelerates the degradation of the catalyst.

SUMMARY OF THE INVENTION

In order to overcome the previously unrecognized and unsolved challenges described above, a preferred embodiment of the present invention provides an engine including a combustion chamber, a crankshaft, an intake passage, a throttle valve, a fuel injector, an exhaust passage, a catalyst, a temperature detecting device, and a controller. An air-fuel mixture of air and fuel is combusted in the combustion chamber. The crankshaft rotates in accordance with the combustion of the air-fuel mixture in the combustion chamber. The intake passage guides a gas toward the combustion chamber. The throttle valve changes the flow rate of the gas supplied from the intake passage to the combustion chamber. The fuel injector injects the fuel into the intake passage or into the combustion chamber. The exhaust passage guides exhaust discharged from the combustion chamber. The catalyst is disposed inside the exhaust passage. The temperature detecting device detects the temperature of the engine. The controller judges whether or not the engine is overheating based on the detection value of the temperature detecting device. If the engine is overheating, the controller is programmed to control the opening degree of the throttle valve or the injection amount of fuel from the fuel injector to decrease the rotational speed of the crankshaft and to control the injection amount of fuel from the fuel injector to set a target air-fuel ratio (target value of the ratio of oxygen and fuel in the air-fuel mixture supplied to the combustion chamber) to a value richer than a stoichiometric air-fuel ratio.

According to this arrangement of a preferred embodiment of the present invention, the gas is supplied from the intake passage to the combustion chamber at the flow rate corresponding to the opening degree of the throttle valve. Further, the fuel injected into the intake passage or into the combustion chamber by the fuel injector is supplied to the combustion chamber. The air-fuel mixture of air and fuel is thus supplied to the combustion chamber and combusts in the combustion chamber. Consequently, the crankshaft rotates.

The exhaust generated by the combustion of the air-fuel mixture is discharged from the combustion chamber to the exhaust passage and is guided to the downstream side by the exhaust passage. The catalyst that purifies the exhaust is disposed inside the exhaust passage. The exhaust that is discharged from the combustion chamber is thus purified by the catalyst in the process of flowing inside the exhaust passage. Exhaust that is eliminated of hazardous substances or is extremely low in residual amounts of hazardous substances is thus discharged from the engine.

The controller is programmed to control the throttle valve to increase or decrease the opening degree of the throttle valve. Similarly, the controller is programmed to control the fuel injector to increase or decrease the injection amount of fuel from the fuel injector. The controller further judges whether or not the engine is overheating based on the detection value of the temperature detecting device that detects the temperature of the engine. The overheating of the engine may be judged based on the absolute value of the temperature or may be judged based on the absolute value and the rise rate of the temperature.

If the controller judges that the engine is overheating, the controller decreases the opening degree of the throttle valve or decreases the injection amount of fuel from the fuel injector. The rotational speed of the crankshaft (the engine speed) thus decreases. The controller further controls the injection amount of fuel from the fuel injector to set the target air-fuel ratio to the value richer than the stoichiometric air-fuel ratio.

When the actual air-fuel ratio is richer than the stoichiometric air-fuel ratio, a portion of the heat of the exhaust is transmitted as heat of vaporization to the excess fuel and the temperature of the exhaust thus decreases. Further, the controller decreases the engine speed, and the heat generation amount of the engine thus decreases. In other words, in addition to the heat generation amount of the engine decreasing due to the decrease of the rotational speed, the exhaust temperature decreases due to the change of the target air-fuel ratio. The controller thus rapidly decreases the temperature rise rate of the engine when overheating occurs. Further, the engine speed is decreased not by misfiring but by adjustment of the opening degree of the throttle valve or adjustment of the injection amount of fuel, and the uncombusted fuel that contacts the catalyst is thus reduced. The degradation of the catalyst is thus prevented.

In a preferred embodiment of the present invention, if the engine is overheating, the controller may judge whether or not the opening degree of the throttle valve is not less than a threshold value. Then, if the opening degree of the throttle valve is not less than the threshold value, the controller may decrease the rotational speed of the crankshaft and set the target air-fuel ratio to a value richer than the stoichiometric air-fuel ratio.

According to this arrangement of a preferred embodiment of the present invention, if the engine is overheating, the controller judges whether or not the opening degree of the throttle valve is not less than the threshold value. Then if the opening degree of the throttle valve is not less than the threshold value, the controller decreases the rotational speed of the crankshaft and sets the target air-fuel ratio to the value richer than the stoichiometric air-fuel ratio. In other words, if the opening degree of the throttle valve is less than the threshold value, the controller does not perform the deceleration control of decreasing the engine speed and the enrichment control of setting the target air-fuel ratio to the value richer than the stoichiometric air-fuel ratio.

The case where "the opening degree of the throttle valve is less than the threshold value" refers, for example, to a case where the opening degree of the throttle valve is an idling opening degree (opening degree of the throttle valve when the engine is idling) or is in the vicinity of the idling opening degree. In this case, the heat generation amount of the engine is low and therefore the engine temperature decreases gradually even if the controller does not perform the deceleration control and the enrichment control. Therefore, by the controller performing the deceleration control and the enrichment control when the opening degree of the throttle valve is not less than the threshold value, the temperature rise rate of the engine is decreased rapidly and the engine control is prevented from being complicated.

In a preferred embodiment of the present invention, the throttle valve may be an electronically controlled throttle valve an opening degree of which is adjusted by the controller. If the engine is overheating, the controller may decrease the opening degree of the throttle valve to decrease the rotational speed of the crankshaft and control the injection amount of fuel from the fuel injector to set the target air-fuel ratio to a value richer than the stoichiometric air-fuel ratio.

According to this arrangement of a preferred embodiment of the present invention, the flow rate of the gas supplied from the intake passage to the combustion chamber is adjusted by the electronically controlled throttle valve. The throttle valve is electrically connected to the controller. The opening degree of the throttle valve is thus controlled by the controller. If the engine is overheating, the controller decreases the opening degree of the throttle valve. The rotational speed of the crankshaft thus decreases and the heat generation amount of the engine decreases. The controller further increases or decreases the injection amount of fuel from the fuel injector to set the target air-fuel ratio to the value richer than the stoichiometric air-fuel ratio. The temperature of the exhaust thus decreases. The controller thus rapidly decreases the temperature rise rate of the engine.

In a preferred embodiment of the present invention, the throttle valve may be a mechanical throttle valve, an opening degree of which is adjusted by an operating force applied to a throttle operating member by a user and transmitted from the throttle operating member to the mechanical throttle valve. The engine may include a plurality of the combustion chambers and a plurality of the fuel injectors respectively corresponding to the plurality of combustion chambers and injecting fuel to be supplied to the plurality of combustion chambers. If the engine is overheating, the controller may stop the injection of fuel from a portion of the plurality of fuel injectors to stop the supply of fuel to a portion of the plurality of combustion chambers to decrease the rotational speed of the crankshaft and may set the target air-fuel ratio of the air-fuel mixture supplied to the remaining combustion chamber(s), to which the supply of fuel is not stopped, to a value richer than the stoichiometric air-fuel ratio.

According to this arrangement of a preferred embodiment of the present invention, the flow rate of the gas supplied from the intake passage to the remaining combustion chamber(s) is adjusted by the mechanical throttle valve. The throttle operating member that is operated by the user is mechanically connected by a wire to the throttle valve. The operating force applied to the throttle operating member by the user is thus transmitted by the wire to the throttle valve. The opening degree of the throttle valve is thus adjusted.

If the engine is overheating, the controller stops the injection of fuel from a portion of the plurality of fuel injectors. The supply of fuel to the portion of the plurality of combustion chambers is thus stopped and the combustion of the air-fuel mixture in these combustion chambers is stopped. The rotational speed of the crankshaft thus decreases. Further, the controller sets the target air-fuel ratio of the air-fuel mixture supplied to the remaining combustion chamber (s), to which the supply of fuel is not stopped, to the value richer than the stoichiometric air-fuel ratio. The temperature of the exhaust discharged from this combustion chamber thus decreases. The controller thus rapidly decreases the temperature rise rate of the engine.

In a preferred embodiment of the present invention, the controller may increase or decrease the number of combustion chambers to which the supply of fuel is stopped in accordance with the rotational speed of the crankshaft.

According to this arrangement of a preferred embodiment of the present invention, the number of combustion chambers to which the supply of fuel is stopped when the engine is overheating is increased or decreased in accordance with the rotational speed of the crankshaft. For example, if the engine speed decreases to less than a lower limit speed, the controller decreases the number of combustion chambers to which the supply of fuel is stopped to increase the engine speed. Also, if the engine speed exceeds an upper limit speed greater than the lower limit speed, the controller increases the number of combustion chambers to which the supply of fuel is stopped to decrease the engine speed. The engine speed is thus adjusted to be within a range of not less than the lower limit speed and not more than the upper limit speed. The controller thus rapidly decreases the temperature rise rate of the engine while securing a minimum engine output.

In a preferred embodiment of the present invention, the controller may include a storage device that stores an initial map that includes a plurality of target air-fuel ratios. The target air-fuel ratios of the initial map may be set according to operation conditions of the engine that include the rotational speed of the crankshaft. If the engine is not overheating, the controller may use the target air-fuel ratios of the initial map. If the engine is overheating, the controller may change all of the target air-fuel ratios of the initial map uniformly to values richer than the stoichiometric air-fuel ratio. The controller may use the initial map after the change as an overheat map.

According to this arrangement of a preferred embodiment of the present invention, the initial map that is used when the engine is in the ordinary state (when the engine is not overheating) is stored in the storage device of the controller. Further, a fixed value (coefficient) that changes the initial map to the overheat map is stored in the storage device of the controller. The plurality of target air-fuel ratios of the initial map are set according to the operation conditions of the engine that include the rotational speed of the crankshaft.

If the engine is not overheating, the controller selects the target air-fuel ratio corresponding to the operation condition of the engine from the initial map and uses the selected target air-fuel ratio. The optimal target air-fuel ratio that is in accordance with the operation condition of the engine is thus used.

On the other hand, if the engine is overheating, the controller changes all of the target air-fuel ratios of the initial map uniformly to the values richer than the stoichiometric air-fuel ratio. In this case, the controller may change all of the target air-fuel ratios of the initial map uniformly to the values richer than the stoichiometric air-fuel ratio by multiplying all of the target air-fuel ratios of the initial map by the fixed value stored in the storage device or by subtracting the fixed value stored in the storage device from all of the target air-fuel ratios of the initial map.

The controller uses the initial map that has been changed by multiplication or subtraction as the overheat map. The target air-fuel ratio is thus set to be richer than the stoichiometric air-fuel ratio and the temperature rise rate of the engine decreases. Further, the fixed value (coefficient) that changes the initial map to the overheat map includes less data than an independent overheat map and the storage device is thus reduced in storage capacity in comparison to a case where both an initial map and an overheat map are stored in the storage device.

In a preferred embodiment of the present invention, the storage device may further store, in place of the fixed value that changes the initial map to the overheat map, an overheat map that includes a plurality of target air-fuel ratios respectively corresponding to the plurality of target air-fuel ratios of the initial map. Each target air-fuel ratio of the overheat map may be set to a value that is richer than the corresponding target air-fuel ratio of the initial map and richer than the stoichiometric air-fuel ratio. If the engine is not overheating, the controller may use the target air-fuel ratios of the initial map. If the engine is overheating, the controller may use the target air-fuel ratios of the overheat map.

According to this arrangement of a preferred embodiment of the present invention, the initial map that is used when the engine is in the ordinary state (when the engine is not overheating) is stored in the storage device of the controller. Further, the overheat map that is used when the engine is overheating is stored in the storage device of the controller. That is, two independent maps (the initial map and the overheat map) are stored in the storage device of the controller.

The plurality of target air-fuel ratios of the overheat map respectively correspond to the plurality of target air-fuel ratios of the initial map. The plurality of target air-fuel ratios of the overheat map are thus set according to the operation conditions of the engine. Further, each target air-fuel ratio of the overheat map is set to a value that is richer than the corresponding target air-fuel ratio of the initial map and richer than the stoichiometric air-fuel ratio.

If the engine is overheating, the controller uses the target air-fuel ratios of the overheat map. The target air-fuel ratio is thus set to be richer than the stoichiometric air-fuel ratio and the temperature rise rate of the engine decreases. Further, the overheat map is not prepared from the initial map by using a coefficient but is independent of the initial map and the controller thus uses the overheat map that has been set individually without dependence on the initial map.

In a preferred embodiment of the present invention, at least a portion of the exhaust passage may be made of a material that contains aluminum, for example.

According to this arrangement of a preferred embodiment of the present invention, all or a portion of the exhaust passage is made of the material containing aluminum, which is an example of a light metal. The engine is thus light in weight. On the other hand, aluminum is lower in heat resistance than iron and, therefore, the heat resistance of the exhaust passage is lower than when the entire exhaust passage is made of a material having iron as the main component. However, the temperature rise of the engine is reduced as described above and, therefore, not only the engine is light in weight but melting of a portion of the exhaust passage is also prevented.

In a preferred embodiment of the present invention, the temperature detecting device may be a device that detects the temperature of the outer wall of the engine.

According to this arrangement of a preferred embodiment of the present invention, the temperature of the outer wall of the engine is detected by the temperature detecting device. For example, the temperature of at least one of a cylinder body, a cylinder head, and a crankcase is detected by the temperature detecting device. The temperature of the outer wall of the engine changes when an abnormality occurs in a cooling device of the engine. The temperature of the outer wall of the engine has a high sensitivity with respect to an abnormality of the cooling device. Especially when the engine is made of a material that contains aluminum, which is higher in thermal conductivity than iron, the temperature of the outer wall of the engine changes in a short time when an abnormality occurs in the cooling device. The controller judges whether or not the engine is overheating based on the temperature of the outer wall of the engine. The time from occurrence of an abnormality in the cooling device to detection of the abnormality is thus shortened.

Another preferred embodiment of the present invention provides an outboard motor including the engine, an engine supporting member supporting the engine such that the rotational axis of the crankshaft extends in the up/down direction, a driveshaft extending in the up/down direction below the engine and driven to rotate by the engine, a propeller shaft, to which the power transmitted from the engine to the driveshaft is transmitted and which rotates together with a propeller, a cooling water passage covering at least a portion of the catalyst, and a water pump driven by the engine to take in water outside the outboard motor from a water inlet that opens underwater and supply the water to the cooling water passage.

According to this arrangement of a preferred embodiment of the present invention, the engine is supported by the engine supporting member such that the rotational axis of the crankshaft extends in the up/down direction. The driveshaft that is driven to rotate by the engine extends in the up/down direction below the engine. The rotation of the engine is transmitted to the propeller shaft via the driveshaft. The propeller thus rotates and a thrust that propels the vessel is generated.

The water pump is driven by the engine. The water pump takes water outside the outboard motor into the interior of the outboard motor from the water inlet that opens underwater. The water taken into the interior of the outboard motor by the water pump is supplied as cooling water to the cooling water passage. The cooling water passage covers at least a portion of the catalyst. The catalyst is thus cooled by the water flowing through the cooling water passage.

With an internal circulation cooling device that is included in an automobile, etc., when the output of the engine increases, the temperature of the cooling water may increase accordingly. In contrast, with the cooling device of an outboard motor, the water outside the vessel, which is substantially fixed in temperature, is used as the cooling water and the cooling ability is thus very stable. On the other hand, with the cooling device of the outboard motor, the water inlet opens underwater and the water inlet may be clogged by underwater foreign matter, such as seaweed, etc. In this case, the cooling ability of the cooling device decreases temporarily and there is thus a possibility of the engine overheating. Especially with an engine that includes a catalyst, not only is heat generated by the reaction of the catalyst and the exhaust but the exhaust temperature is also high because the target air-fuel ratio is set to the stoichiometric air-fuel ratio under many operation conditions.

However, as mentioned above, if the engine is overheating, the controller not only makes the heat generation amount of the engine decrease by decreasing the rotational speed but also makes the exhaust temperature decrease by changing the target air-fuel ratio. The temperature rise rate of the engine is thus decreased and the temperature change of the engine is gradual. The maximum temperature attained by the engine is thus lowered and the time for the engine temperature to decrease below the overheating temperature is thus shortened.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
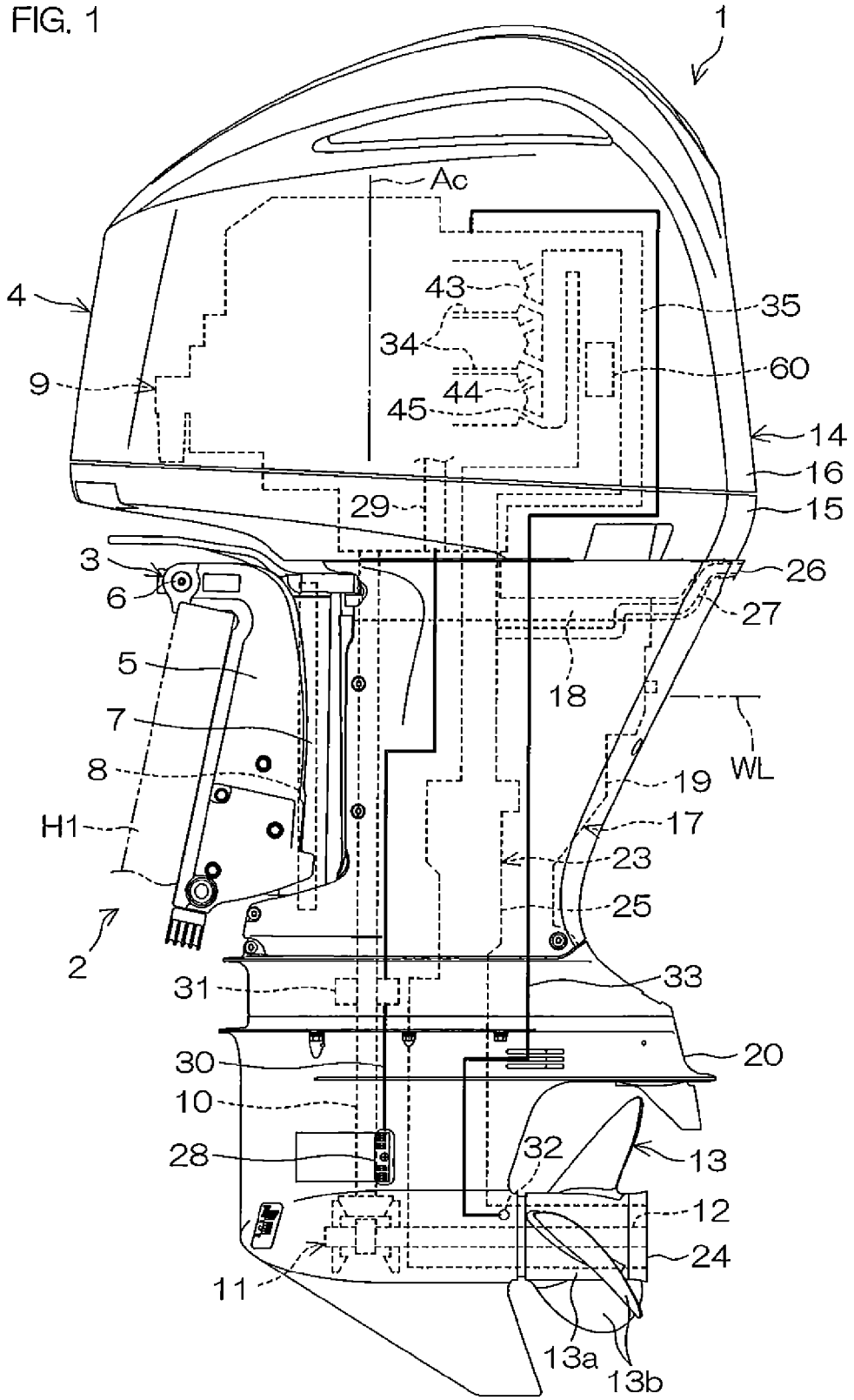
FIG. 1 is a schematic side view of a vessel according to a first preferred embodiment of the present invention.
Figure 2:
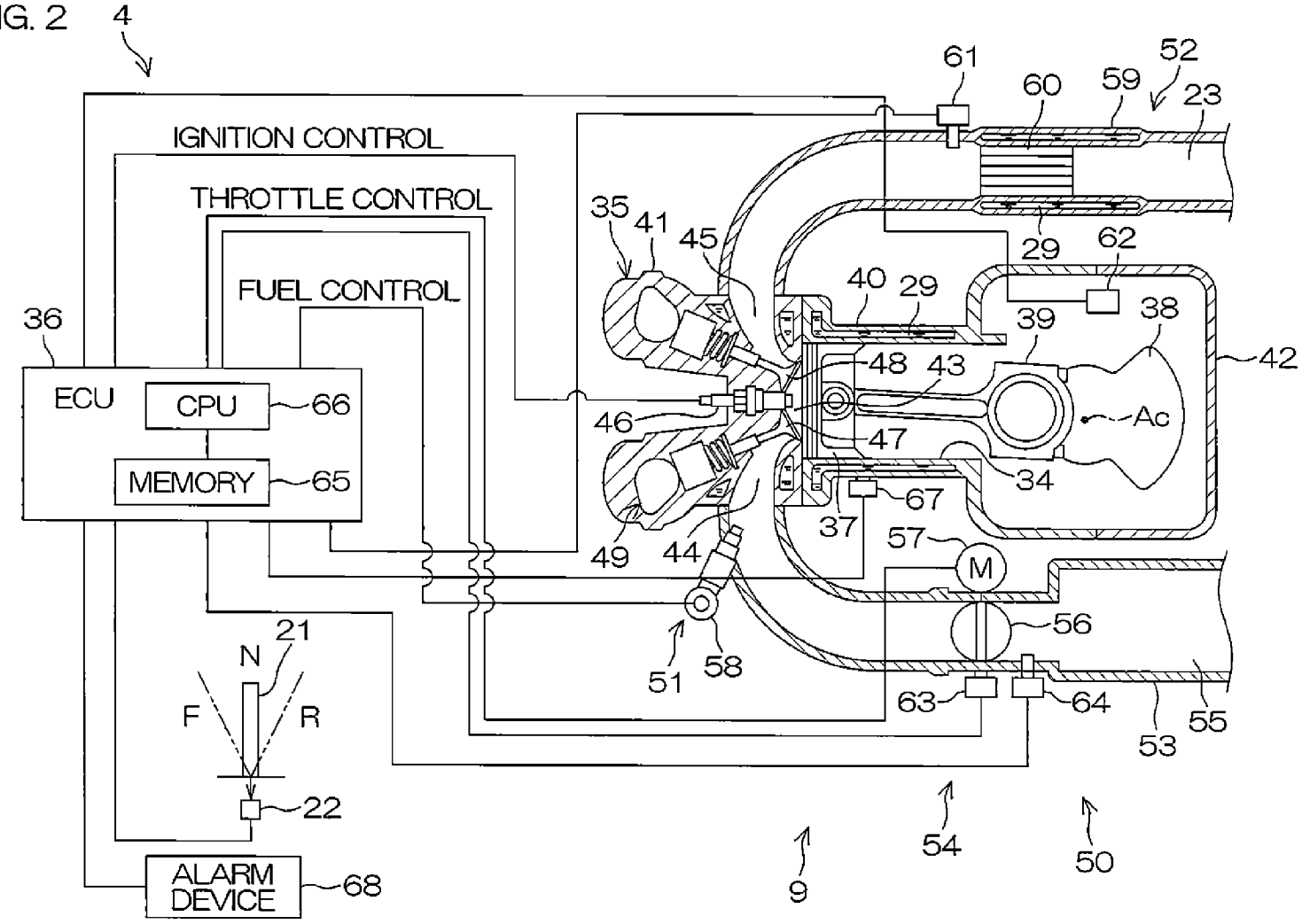
FIG. 2 is a schematic view of the general arrangement of an engine according to the first preferred embodiment of the present invention.
Figure 3:
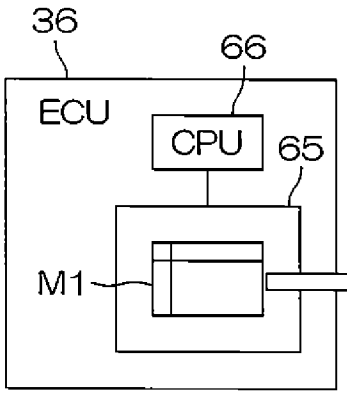
FIG. 3 is a diagram of an example of an initial map.

FIG. 1 is a schematic side view of a vessel 1 according to a first preferred embodiment of the present invention. FIG. 2 is a schematic view of the general arrangement of an engine 9 according to the first preferred embodiment of the present invention. FIG. 3 is a diagram of an example of an initial map M1.

As shown in FIG. 1, the vessel 1 includes a hull H1 that floats on a water surface and a vessel propulsion apparatus 2 that propels the hull H1. The vessel propulsion apparatus 2 includes a suspension device 3, mountable to a rear portion (stern) of the hull H1, and an outboard motor 4 coupled to the suspension device 3.

As shown in FIG. 1, the suspension device 3 includes a pair of right and left clamp brackets 5 to be mounted on the hull H1, a tilting shaft 6 supported by the pair of clamp brackets 5 extending in the right/left direction, and a swivel bracket 7 mounted on the tilting shaft 6. The suspension device 3 further includes a steering shaft 8 supported by the swivel bracket 7 extending in the up/down direction.

As shown in FIG. 1, the outboard motor 4 is connected to the steering shaft 8. The steering shaft 8 is supported by the swivel bracket 7 in a manner enabling rotation around a steering axis (center line of the steering shaft 8) extending in the up/down direction. The swivel bracket 7 is supported by the clamp brackets 5 via the tilting shaft 6. The swivel bracket 7 is rotatable around a tilt axis (center line of the tilting shaft 6) extending in the right/left direction with respect to the clamp brackets 5. The outboard motor 4 is rotatable to the right and left with respect to the suspension device 3 and is rotatable up and down with respect to the suspension device 3. The outboard motor 4 is thus rotatable to the right and left with respect to the hull H1 and is rotatable up and down with respect to the hull H1.

As shown in FIG. 1, the outboard motor 4 includes an engine 9 that generates power that rotates a propeller 13 and a power transmission device that transmits the power of the engine 9 to the propeller 13. The power transmission device includes a driveshaft 10 coupled to the engine 9, a forward/reverse switching mechanism 11 coupled to the driveshaft 10, and a propeller shaft 12 coupled to the forward/reverse switching mechanism 11. The outboard motor 4 further includes an engine cover 14 covering the engine 9 and a casing 17 housing the power transmission device.

As shown in FIG. 1, the engine cover 14 houses the engine 9. The engine cover 14 includes a cup-shaped bottom cover 15 that is upwardly open and a cup-shaped top cover 16 that is downwardly open. The top cover 16 is detachably coupled to the bottom cover 15. The opening portion of the top cover 16 vertically overlaps with the opening portion of the bottom cover 15 via a seal (not shown). The bottom cover 15 is mounted on the casing 17 (specifically, an exhaust guide 18 to be described below).

As shown in FIG. 1, the casing 17 includes an exhaust guide 18 disposed below the engine 9, an upper case 19 disposed below the exhaust guide 18, and a lower case 20 disposed below the upper case 19. The engine 9 is mounted on the exhaust guide 18. The engine 9 is disposed higher than the steering shaft 8. The exhaust guide 18 that serves as an engine supporting member supports the engine 9 with the rotational axis (crank axis Ac) of the engine 9 having a vertical attitude.

As shown in FIG. 1, the engine 9 is disposed above the driveshaft 10. The driveshaft 10 extends in the up/down direction inside the casing 17. A center line of the driveshaft 10 may be disposed on the rotational axis of the engine 9 or may be shifted with respect to the rotational axis of the engine 9. An upper end portion of the driveshaft 10 is coupled to the engine 9 and a lower end portion of the driveshaft 10 is coupled to a front end portion of the propeller shaft 12 via the forward/reverse switching mechanism 11. The propeller shaft 12 extends in the front/rear direction inside the casing 17. A rear end portion of the propeller shaft 12 projects to the rear from the casing 17. The propeller 13 is detachably coupled to the rear end portion of the propeller shaft 12. The propeller 13 includes an outer cylinder 13*a* surrounding the propeller shaft 12 around a propeller axis (a center line of the propeller shaft 12) and a plurality of blades 13*b* extending outward from the outer cylinder 13*a*. The outer cylinder 13*a* and the blades 13*b* rotate together with the propeller shaft 12 around the propeller axis.

The engine 9 is an internal combustion engine. The engine 9 rotates in a fixed rotation direction. The rotation of the engine 9 is transmitted to the propeller 13 by the power transmission device (the driveshaft 10, the forward/reverse switching mechanism 11, and the propeller shaft 12). The propeller 13 is thus caused to rotate together with the propeller shaft 12 and a thrust that propels the vessel 1 forward or in reverse is generated. Also, the direction of the rotation transmitted from the driveshaft 10 to the propeller shaft 12 is switched by the forward/reverse switching mechanism 11. The rotation direction of the propeller 13 and the propeller shaft 12 is thus switched between a forward rotation direction (clockwise direction when the propeller 13 is viewed from the rear) and a reverse rotation direction (direction of rotation opposite to the forward rotation direction). The direction of thrust is thus switched.

As shown in FIG. 2, the vessel propulsion apparatus 2 includes a remote control lever 21, operated by a user to perform output adjustment of the engine 9 and switching between forward drive and reverse drive of the vessel 1 and an accelerator position sensor 22 that detects the position of the remote control lever 21. The remote control lever 21 is disposed at a vessel operator compartment provided on the hull H1. The output of the engine 9 is changed by operation of the remote control lever 21. Further, the rotation direction of the propeller 13 is switched by operation of the remote control lever 21. The remote control lever 21 is a throttle operating member that serves in common as a throttle lever and a shift lever. The vessel propulsion apparatus 2 may instead include a throttle lever and a shift lever that are operable independently of each other.

As shown in FIG. 1, the outboard motor 4 includes an exhaust passage 23 by which the exhaust generated at the engine 9 is discharged to the exterior of the outboard motor 4. The exhaust passage 23 is provided in the interior of the outboard motor 4. The exhaust passage 23 includes an exhaust outlet 24 that opens at a rear end portion of the propeller 13 (rear end portion of the outer cylinder 13*a*) and a main exhaust passage 25 extending from combustion chambers 43 of the engine 9 to the exhaust outlet 24. The exhaust passage 23 further includes an idle exhaust outlet 26 opening at the outer surface of the outboard motor 4 and an idle exhaust passage 27 extending from the main exhaust passage 25 to the idle exhaust outlet 26.

As shown in FIG. 1, the main exhaust passage 25 extends downward from the engine 9 to the propeller shaft 12 via the exhaust guide 18 and extends rearward along the propeller shaft 12. The main exhaust passage 25 opens rearward at the rear end portion of the propeller 13. The exhaust outlet 24 is thus disposed underwater. The idle exhaust outlet 26 and the idle exhaust passage 27 are disposed higher than the exhaust outlet 24. The idle exhaust passage 27 branches from the main exhaust passage 25. The idle exhaust outlet 26 is disposed higher than a waterline WL (height of the water surface when the vessel 1, with the vessel propulsion apparatus 2 installed, is stopped). The idle exhaust outlet 26 thus opens into air.

The exhaust generated in the combustion chambers 43 is discharged into the main exhaust passage 25 and is guided toward the exhaust outlet 24. When the output of the engine 9 is high, the exhaust inside the main exhaust passage 25 is mainly discharged underwater from the exhaust outlet 24. Also, a portion of the exhaust inside the main exhaust passage 25 is guided to the idle exhaust outlet 26 by the idle exhaust passage 27 and is released into the atmosphere from the idle exhaust outlet 26. On the other hand, when the output of the engine 9 is low (for example, when the engine 9 is idling), the exhaust pressure inside the main exhaust passage 25 is low and the exhaust inside the main exhaust passage 25 is thus mainly released into the atmosphere from the idle exhaust outlet 26.

As shown in FIG. 1, the outboard motor 4 includes a water-cooled type cooling device that cools the interior of the outboard motor 4. The cooling device includes a water inlet 28 opening at the outer surface of the outboard motor 4, a cooling water passage 29 (water jacket) provided in the engine 9, a water supply passage 30 extending from the water inlet 28 to the cooling water passage 29, and a water pump 31 that takes the water outside the outboard motor 4 into the interior of the outboard motor 4 from the water inlet 28 as the cooling water. The cooling device further includes a water outlet 32 opening inside the exhaust passage 23 and a drain passage 33 extending inside the outboard motor 4 from the cooling water passage 29 to the water outlet 32.

As shown in FIG. 1, the water inlet 28 is disposed lower than the cooling water passage 29 and the water pump 31. The water inlet 28 opens at the outer surface of the lower case 20. The water inlet 28 is thus disposed underwater. The water inlet 28 is connected to the cooling water passage 29 via the water supply passage 30 provided in the interior of the outboard motor 4. The water pump 31 is disposed in the water supply passage 30. The water pump 31 is thus disposed in the interior of the outboard motor 4. The water pump 31 is disposed lower than the engine 9.

As shown in FIG. 1, the water pump 31 is preferably mounted on the driveshaft 10. The water pump 31 is preferably a rotary pump that includes an impeller, rotating together with the driveshaft 10, and a pump case, housing the impeller. When the engine 9 rotates the driveshaft 10, the impeller rotates inside the pump case and a suction force that sucks the water outside the outboard motor 4 into the water inlet 28 is generated. The water pump 31 is thus driven by the engine 9.

As the cooling water, the water outside the outboard motor 4 is sucked into the water supply passage 30 from the water inlet 28 and is delivered from the water supply passage 30 to the cooling water passage 29 via the water pump 31. High-temperature portions of the engine 9, etc., are thus cooled by the cooling water. The cooling water supplied to the engine 9 is guided by the drain passage 33 to the water outlet 32 and discharged from the water outlet 32 disposed inside the exhaust passage 23. The cooling water is thus discharged underwater from the exhaust outlet 24 together with the exhaust.

As shown in FIG. 1, the engine 9 includes an engine main body 35 provided with a plurality of cylinders 34. As shown in FIG. 2, the engine 9 includes an ECU (electronic control unit) 36 as a controller that is programmed to control the engine 9. The engine 9 may be an in-line engine or a V-type engine or an engine of a type besides these. Also, the engine 9 is not restricted to being a multi-cylinder engine and may be a single cylinder engine instead.

As shown in FIG. 2, the engine main body 35 includes a plurality of pistons 37 respectively disposed inside the plurality of cylinders 34, a crankshaft 38 rotatable around the crank axis Ac extending in the up/down direction, and a plurality of connecting rods 39 coupling the plurality of pistons 37 respectively to the crankshaft 38. The engine main body 35 further includes a cylinder body 40 housing the plurality of pistons 37, a cylinder head 41, which, together with the cylinder body 40, defines the plurality of cylinders 34, and a crankcase 42 housing the crankshaft 38. The cylinder head 41 and the crankcase 42 are mounted on the cylinder body 40.

As shown in FIG. 2, the engine main body 35 includes a plurality of each of the combustion chambers 43, intake ports 44, and exhaust ports 45 that are provided in the cylinder head 41. Each of the intake ports 44 and exhaust ports 45 opens at the outer surface of the cylinder head 41 and extends from the outer surface of the cylinder head 41 to the inner surface of the corresponding combustion chamber 43. The engine 9 includes a plurality of spark plugs 46 that cause combustion of an air-fuel mixture of air and fuel inside the plurality of combustion chambers 43, a plurality of intake valves 47 opening and closing the plurality of intake ports 44, a plurality of exhaust valves 48 opening and closing the plurality of exhaust ports 45, and a valve mechanism 49 that moves the pluralities of intake valves 47 and exhaust valves 48.

As shown in FIG. 2, the engine 9 includes an intake device 50 supplying air to the plurality of combustion chambers 43, a fuel supplying device 51 supplying fuel to the plurality of combustion chambers 43, and an exhaust device 52 discharging the exhaust generated at the plurality of combustion chambers 43. The intake device 50, the fuel supplying device 51, and the exhaust device 52 are mounted on the engine main body 35.

As shown in FIG. 2, the intake device 50 includes an intake pipe 53 supplying air to the plurality of combustion chambers 43 via the plurality of intake ports 44 and a plurality of electronically controlled throttle valves 54 adjusting the flow rates of air supplied from the intake pipe 53 to the plurality of combustion chambers 43. The intake pipe 53 is mounted on the cylinder head 41 and the interior of the intake pipe 53 is connected to the respective intake ports 44. The intake ports 44 and the intake pipe 53 define a portion of an intake passage 55 that guides air to the combustion chambers 43. Each throttle valve 54 includes a valve disk 56 disposed in the intake passage 55 and an electric motor 57 that rotates the valve disk 56 around an axis extending along the diameter of the valve disk 56.

As shown in FIG. 2, the fuel supplying device 51 includes a plurality of fuel injectors 58 supplying fuel to the plurality of combustion chambers 43. The fuel injectors 58 are provided respectively according to the combustion chambers 43. The injection amount of fuel from each fuel injector 58 is adjusted by the ECU 36. A fuel outlet of the fuel injector 58 that injects the fuel is disposed inside the intake pipe 53. The fuel outlet is thus disposed in the intake passage 55. The fuel outlet may instead be disposed inside the intake port 44 or inside the combustion chamber 43 instead. That is, the engine 9 may be a port-injection engine or may be a direct-injection engine.

As shown in FIG. 2, the exhaust device 52 includes an exhaust pipe 59 guiding the exhaust discharged from the plurality of combustion chambers 43 via the plurality of exhaust ports 45, a catalyst 60 purifying the exhaust discharged from the plurality of combustion chambers 43, and an air-fuel ratio sensor 61 detecting an air-fuel ratio of the exhaust flowing into the catalyst 60. The exhaust pipe 59 is mounted on the cylinder head 41 and the interior of the exhaust pipe 59 is connected to the respective exhaust ports 45. The exhaust pipe 59 is preferably made, for example, of an aluminum alloy. Similarly, the cylinder body 40 and the cylinder head 41 are preferably made, for example, of an aluminum alloy. The cylinder body 40, the cylinder head 41, and the exhaust pipe 59 define a portion of the exhaust passage 23. The portion of the exhaust passage 23 is thus made of a material that contains aluminum, which is an example of a light metal that is lighter than iron.

As shown in FIG. 2, the catalyst 60 is disposed inside the exhaust pipe 59. The catalyst 60 is thus disposed in the exhaust passage 23. The catalyst 60 is covered by the cooling water passage 29. The catalyst 60 is preferably, for example, a three-way catalyst. The catalyst 60 includes a honeycomb-shaped carrier, through the interior of which the exhaust passes, and a catalytic substance held on the surface of the carrier. The air-fuel ratio sensor 61 is disposed between the combustion chambers 43 and catalyst 60 in the direction of flow of the exhaust. The air-fuel ratio sensor 61 is thus disposed further upstream than the catalyst 60. The air-fuel ratio sensor 61 preferably is an oxygen concentration sensor that detects the oxygen concentration in the exhaust. The air-fuel ratio of the air-fuel mixture supplied to each combustion chamber 43 is adjusted based on the detection value of the air-fuel ratio sensor 61.

As shown in FIG. 1, the catalyst 60 is disposed higher than the exhaust guide 18. Further, the catalyst 60 is housed inside the engine cover 14. The catalyst 60 may be disposed lower than the exhaust guide 18 or may be disposed at the same height as the exhaust guide 18. The distance between the engine main body 35 and the catalyst 60 is short because the engine main body 35 and the catalyst 60 are disposed inside the engine cover 14. The combustion heat is thus transmitted efficiently to the catalyst 60. The catalyst 60 is thus heated rapidly to a temperature higher than the ambient temperature even immediately after the engine 9 is started. A three-way catalyst is low in purification ability (reduction ability) when the temperature is low. The exhaust purification efficiency is thus improved by rapidly raising the temperature of the catalyst 60.

As shown in FIG. 2, the engine 9 includes a rotation angle sensor 62 detecting the rotation angle of the crankshaft 38 (rotation angle of the engine 9). The rotation angle sensor 62 is electrically connected to the ECU 36. That is, the rotation angle sensor 62 is wired or wirelessly connected to the ECU 36 so as to be able to communicate with the ECU 36. Similarly, the spark plugs 46 and the fuel injectors 58 are electrically connected to the ECU 36. The ECU 36 causes the spark plugs 46 to ignite at predetermined ignition timings based on the detection value of the rotation angle sensor 62, that is, based on the rotation angle of the crankshaft 38 (ignition control). The ECU 36 further makes the fuel injectors 58 inject fuel at predetermined fuel injection timings based on the detection value of the rotation angle sensor 62 (fuel control).

As shown in FIG. 2, the ECU 36 is electrically connected to the electric motor 57 of each throttle valve 54. Further, the ECU 36 is electrically connected to the accelerator position sensor 22 that detects the position of the remote control lever 21. The ECU 36 is programmed to control the opening degree of the throttle valve 54 based on the detection value of the accelerator position sensor 22, that is, based on the position of the remote control lever 21 as the throttle operating member (throttle control). For example, when the remote control lever 21 is made to approach a fully open position, the ECU 36 increases the opening degree of the throttle valve 54.

As shown in FIG. 2, the engine 9 includes a throttle position sensor 63 detecting the opening degree of the throttle valve 54 and an intake sensor 64 detecting the flow rate of the intake gas supplied to the combustion chamber 43. The throttle position sensor 63 and the intake sensor 64 are electrically connected to the ECU 36. The flow rate of the intake gas supplied to the combustion chamber 43 is adjusted by the opening degree of the throttle valve 54. The ECU 36 calculates the flow rate of the intake gas supplied to the combustion chamber 43 based on the detection value of the intake sensor 64. The ECU 36 then adjusts the amount of fuel to be injected by the fuel injectors 58 based on the flow rate of the intake gas supplied to the combustion chamber 43. The air-fuel mixture that is adjusted in the ratio of air and fuel is thus supplied to the combustion chamber 43.

As shown in FIG. 3, the ECU 36 includes a storage device 65 storing programs and other information and a CPU (central processing unit) 66 executing the programs stored in the storage device 65. An initial map M1, which includes a plurality of target air-fuel ratios (target values of the ratio of oxygen and fuel in the air-fuel mixture supplied to the combustion chambers 43, the λ in FIG. 3) that are set according to operation conditions of the engine 9, is stored in the storage device 65. The plurality of target air-fuel ratios of the initial map M1 are set according to the engine speed of the engine 9 and according to the supply flow rate of the intake gas. The catalyst 60 is preferably a three-way catalyst, with which the purification efficiency is highest at a stoichiometric air-fuel ratio or a vicinity thereof. At least a portion of the plurality of target air-fuel ratios of the initial map M1 is set to the stoichiometric air-fuel ratio. The air-fuel ratio of the air-fuel mixture supplied to the combustion chamber 43 is thus made close to the stoichiometric air-fuel ratio and the exhaust is purified efficiently.

As shown in FIG. 2, the engine 9 includes a temperature detecting device 67 that detects the temperature of the engine 9. The outboard motor 4 includes an alarm device 68 that notifies a vessel occupant of an abnormality. The ECU 36 is electrically connected to the temperature detecting device 67 and the alarm device 68. The temperature detecting device 67 may be a temperature measuring device that measures the temperature of the engine 9 or may be a thermo switch that automatically switches between on and off in accordance with the temperature of the engine 9. Also, the alarm device 68 may be an alarm lamp that notifies the abnormality by light or may be an alarm buzzer that notifies the abnormality by sound or may be an alarm display device that displays the abnormality by at least one of either characters or a figure.

As shown in FIG. 2, the temperature detecting device 67 is mounted on the outer wall of the engine main body 35. The temperature detecting device 67 detects the temperature of the outer wall of the engine 9. The temperature of at least one of the cylinder body 40, cylinder head 41, and crankcase 42 is thus detected by the temperature detecting device 67. The ECU 36 judges whether or not the engine 9 is overheating based on the temperature detecting device 67. If the ECU 36 judges that the engine 9 is overheating, the ECU 36 notifies the overheating of the engine 9 to the vessel occupant by the alarm device 68.

Figure 4:
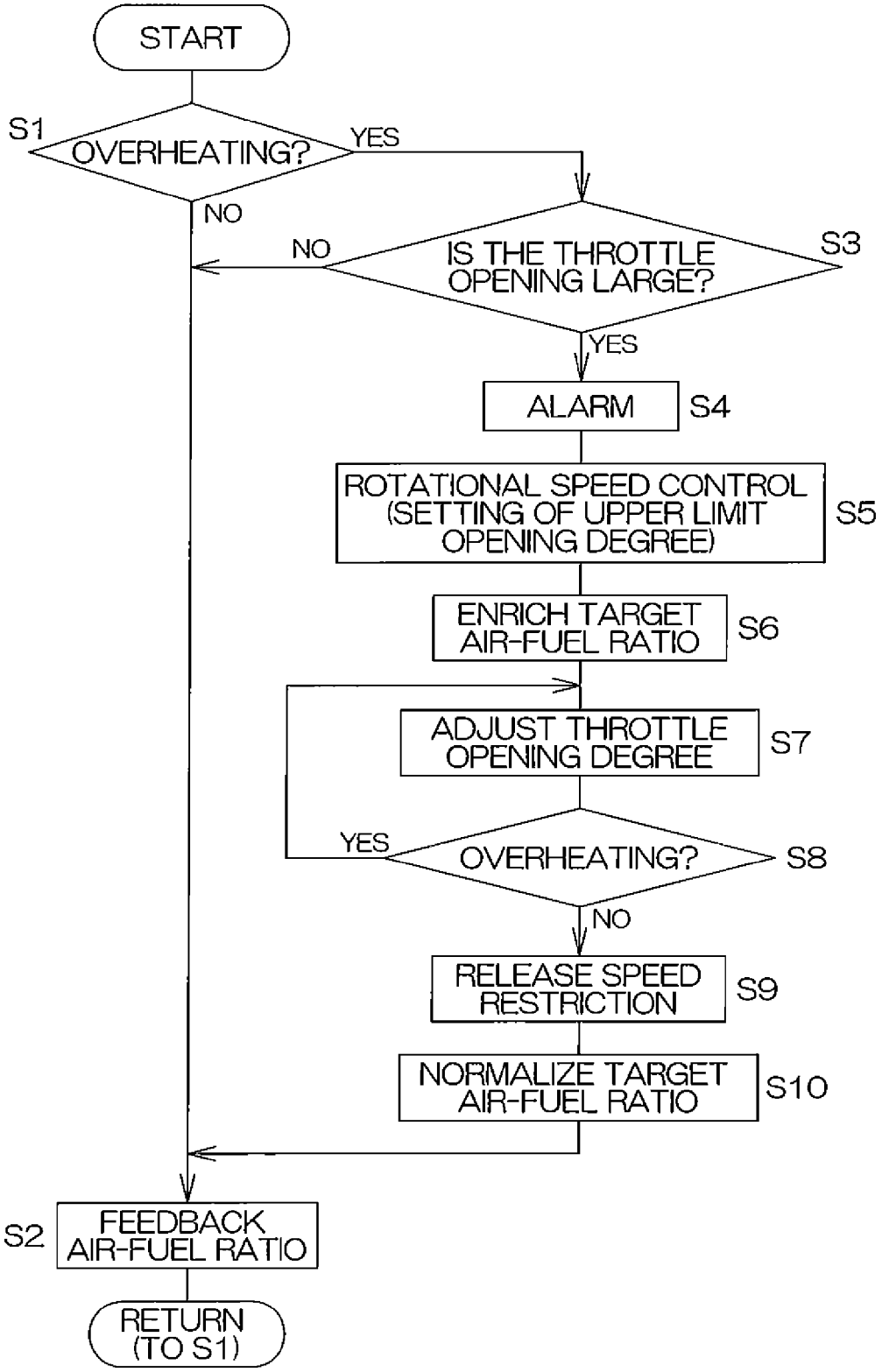
FIG. 4 is a flowchart of an example of a flow when the engine is overheating.
Figure 5A:
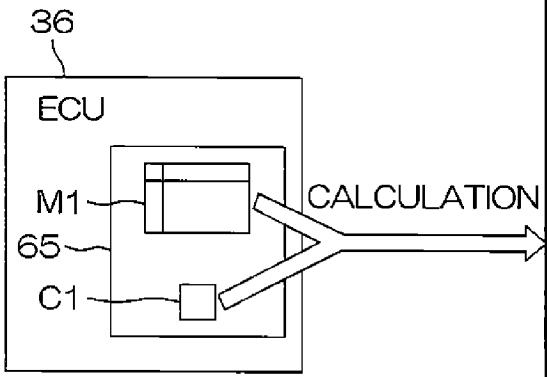
FIG. 5A is a diagram of concepts of changing an initial map to an overheat map by using a coefficient.
Figure 5B:
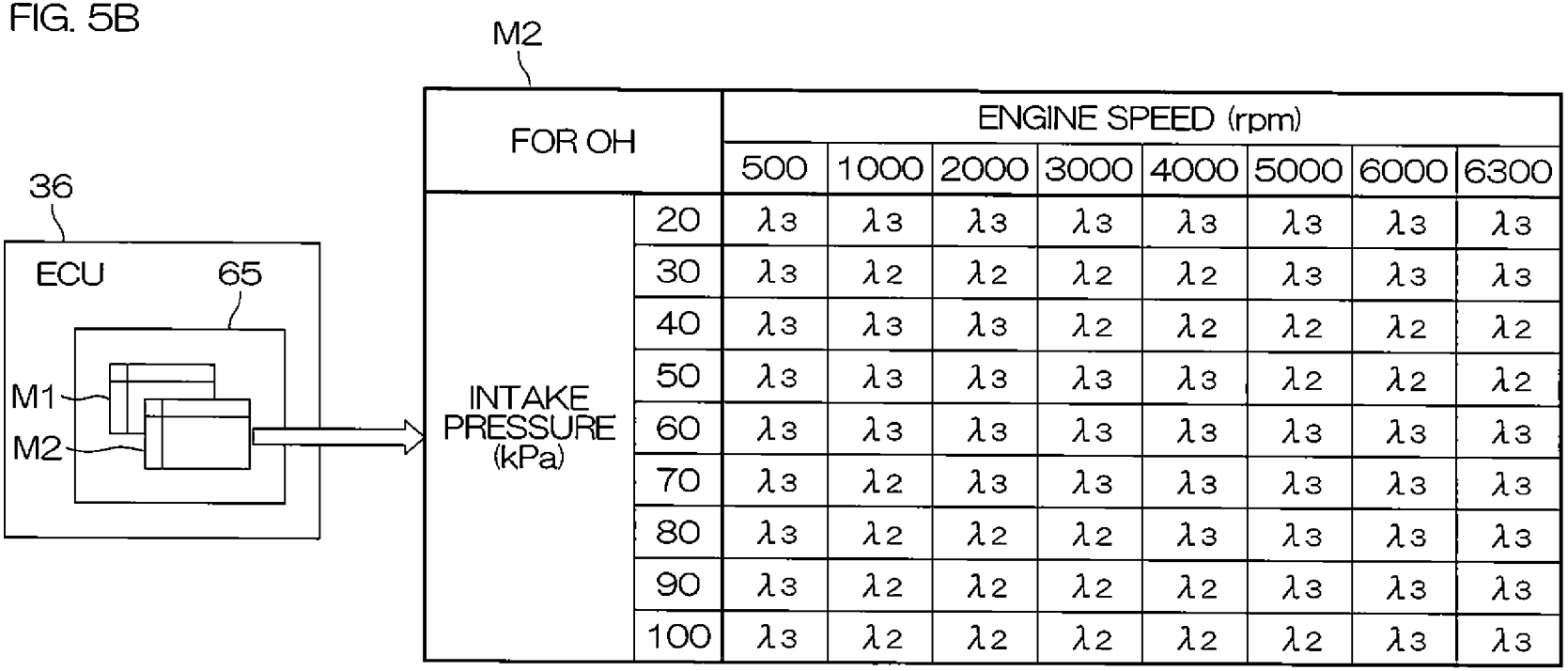
FIG. 5B is a diagram of concepts of using the initial map and an overheat map separately according to different conditions.

FIG. 4 is a flowchart of an example of a flow when the engine 9 is overheating. FIG. 5A is a diagram of concepts of changing the initial map M1 to an overheat map by using a coefficient C1. FIG. 5B is a diagram of concepts of using the initial map M1 and an overheat map M2 separately according to different conditions. FIG. 2 and FIG. 4 shall be referenced in the following description. FIG. 5A and FIG. 5B shall be referenced where suitable.

Based on the detection value of the temperature detecting device 67, the ECU 36 judges whether or not the temperature of the engine 9 is not less than an overheating temperature (step S1). That is, the ECU 36 monitors whether or not the engine 9 is overheating.

If the temperature of the engine 9 is less than the overheating temperature and the engine 9 is not overheating (in the case of No in step S1), the ECU 36 calculates, based on the detection value of the air-fuel ratio sensor 61, the air-fuel ratio of the air-fuel mixture that has actually been supplied to the combustion chamber 43 and adjusts the amount of fuel to be injected subsequently by the fuel injectors 58 (step S2). The actual air-fuel ratio is thus fed back to the fuel injection amount and the actual air-fuel ratio is made to approach the target air-fuel ratio.

On the other hand, if the temperature of the engine 9 is not less than the overheating temperature and the engine 9 is overheating (in the case of Yes in step S1), the ECU 36 judges, based on the detection value of the throttle position sensor 63, whether or not the opening degree of the throttle valve 54 is not less than a threshold value. If the opening degree of the throttle valve 54 is less than the threshold value and the opening degree of the throttle valve 54 is small (in the case of No in step S3), the temperature of the engine 9 decreases gradually. Therefore, in this case, the ECU 36 feeds back the actual air-fuel ratio to the fuel injection amount (step S2). The ECU 36 then judges again whether or not the engine 9 is overheating (returns to step S1).

Also, if the opening degree of the throttle valve 54 is not less than the threshold value (in the case of Yes in step S3), the ECU 36 notifies the occurrence of overheating to the vessel occupant by the alarm device 68 (step S4). Thereafter, the ECU 36 sets the throttle valve 54 to an upper limit opening degree to decrease the engine speed of the engine 9. Further, the ECU 36 changes the target air-fuel ratio to a value richer than the stoichiometric air-fuel ratio to increase the proportion of the fuel. In this process, the ECU 36 may use the factor C1 stored in the storage device 65 to change the initial map M1 to the overheat map as shown in FIG. 5A or may use the overheat map M2, which is separate from the initial map M1, as shown in FIG. 5B.

FIG. 5A shows the concept of changing the initial map M1 to the overheat map by using the coefficient C1. The storage device 65 stores the initial map M1 and the coefficient C1. If overheating occurs and the opening degree of the throttle valve 54 is not less than the threshold value, the ECU 36 multiplies all of the target air-fuel ratios of the initial map M1 by the fixed value (coefficient C1) stored in the storage device 65 or subtracts the fixed value (coefficient C1) stored in the storage device 65 from all of the target air-fuel ratios of the initial map M1 to uniformly change all of the target air-fuel ratios of the initial map M1 to values richer than the stoichiometric air-fuel ratio. The ECU 36 then uses the changed initial map M1 as the overheat map. The ECU 36 thus controls the fuel injectors 58 based on the target air-fuel ratios of the changed initial map M1 to increase the proportion of fuel contained in the air-fuel mixture.

FIG. 5B shows the concept of using the initial map M1 and the overheat map M2 separately according to different conditions. The storage device 65 stores two independent maps (the initial map M1 and the overheat map M2). The overheat map M2 includes a plurality of target air-fuel ratios respectively corresponding to the plurality of target air-fuel ratios of the initial map M1. The plurality of target air-fuel ratios of the overheat map M2 are thus set according to the operation conditions of the engine 9. Each of the target air-fuel ratios of the overheat map M2 is richer than the corresponding target air-fuel ratio of the initial map M1 and is richer than the stoichiometric air-fuel ratio. If the engine 9 is overheating and the opening degree of the throttle valve 54 is not less than the threshold value, the ECU 36 uses the target air-fuel ratios of the overheat map M2.

After changing the target air-fuel ratio to the value richer than the stoichiometric air-fuel ratio, the ECU 36 adjusts the actual opening degree of the throttle valve 54 to not more than the upper limit opening degree (step S7). Specifically, based on the detection value of the accelerator position sensor 22, the ECU 36 calculates a command value of the opening degree of the throttle valve 54 that has been input by the user. If the command value of the opening degree is not more than the upper limit opening degree, the ECU 36 controls the electric motor 57 of each throttle valve 54 so that the actual opening degree of the throttle valve 54 matches the command value. On the other hand, if the command value of the opening degree exceeds the upper limit opening degree, the ECU 36 controls the electric motor 57 of each throttle valve 54 so that the actual opening degree of the throttle valve 54 matches the upper limit opening degree. The actual opening degree of the throttle valve 54 is thus adjusted to be not more than the upper limit opening degree and the engine speed of the engine 9 is restricted.

After adjusting the opening degree of the throttle valve 54, the ECU 36 judges again whether or not the engine 9 is overheating (step S8). If the engine 9 is overheating (in the case of Yes in step S8), the ECU 36 continues to adjust the actual opening degree of the throttle valve 54 to be not more than the upper limit opening degree and continues the restriction of the engine speed of the engine 9 (returns to step S7). On the other hand, if the temperature of the engine 9 decreases to less than the overheating temperature (in the case of No in step S8), the ECU 36 releases the restriction of the opening degree of the throttle valve 54 by the upper limit opening degree (step S9).

After releasing the restriction of the throttle opening degree, the ECU 36 returns the target air-fuel ratios to the original values (step S10). Specifically, the ECU 36 changes the overheat map to the initial map M1 by using the coefficient C1 or changes the map from the overheat map M2 to the initial map M1. Then, based on the detection value of the air-fuel ratio sensor 61, the ECU 36 calculates the air-fuel ratio of the air-fuel mixture actually supplied to the combustion chamber 43 to adjust the amount of fuel to be injected subsequently by the fuel injector 58 (step S2).

Figure 6:
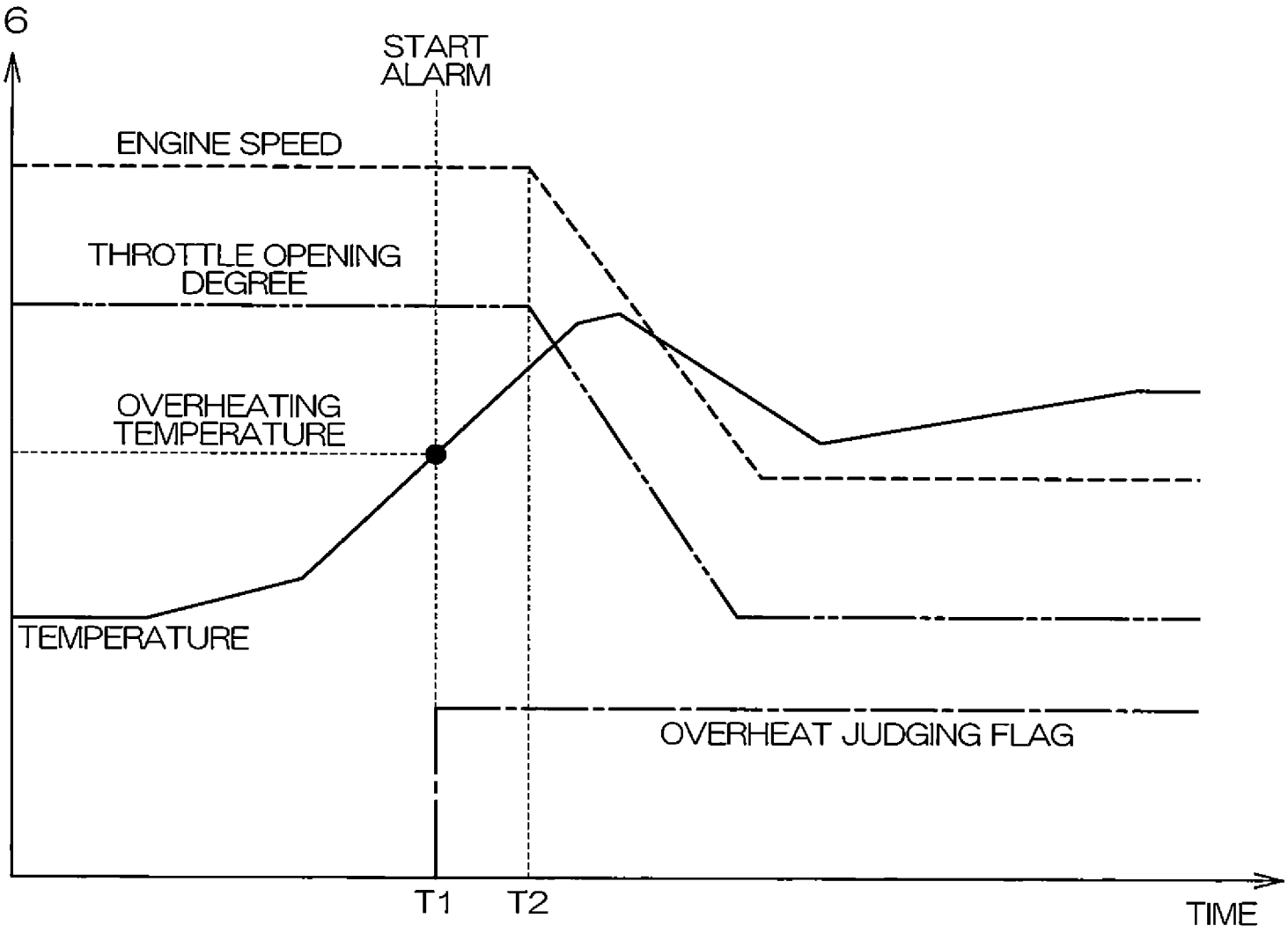
FIG. 6 is a graph of an example of operation of the engine before and after overheating occurs.

FIG. 6 is a graph of an example of operation of the engine 9 before and after overheating occurs.

As shown in FIG. 1, the water inlet 28 from which the water outside the outboard motor 4 is taken in is disposed lower than the waterline WL and is open underwater. The water inlet 28 may be clogged by underwater foreign matter, such as seaweed, etc. The supply flow rate of the cooling water to the cooling water passage 29 may thus decrease or the supply of cooling water to the cooling water passage 29 may stop. Similarly, when the water pump 31 malfunctions, the supply flow rate of the cooling water to the cooling water passage 29 may decrease or the supply of cooling water to the cooling water passage 29 may stop. The cooling ability of the cooling device may thus decrease and the temperature of the engine 9 may rise.

Specifically, as shown in FIG. 6, when an abnormality occurs in the cooling device, the temperature of the engine 9 begins to rise. When the temperature of the engine 9 reaches the overheating temperature (see time T1 in FIG. 6), the ECU 36 notifies the vessel occupant of the abnormality of the cooling device by the alarm device 68. That is, if the engine 9 overheats, there is a possibility of the vessel 1 decelerating due to the restriction of the engine speed of the engine 9 and the ECU 36 thus uses the alarm device 68 to notify the vessel occupant of this possibility.

Also, when the temperature of the engine 9 reaches the overheating temperature, the ECU 36 sets a flag for enrichment control, by which the target air-fuel ratio is set to a value richer than the stoichiometric air-fuel ratio. The enrichment control is thus started and an air-fuel mixture that is more concentrated in fuel than in the case of the stoichiometric air-fuel ratio is supplied to the combustion chamber 43. The ECU 36 further starts the deceleration control of lowering the engine speed of the engine 9 by adjusting the opening degree of the throttle valve 54 (see time T2 in FIG. 6). The temperature rise rate of the engine 9 is thus decreased and the temperature of the engine 9 decreases gradually.

As described above, with the first preferred embodiment, if the ECU 36 judges that the engine 9 is overheating, the ECU 36 decreases the opening degree of the throttle valve 54. The rotational speed of the crankshaft 38 (the engine speed of the engine 9) thus decreases. The ECU 36 further controls the injection amount of fuel from the fuel injector 58 to set the target air-fuel ratio to a value richer than the stoichiometric air-fuel ratio.

When the actual air-fuel ratio is richer than the stoichiometric air-fuel ratio, a portion of the heat of the exhaust is transmitted as heat of vaporization to the excess fuel and the temperature of the exhaust thus decreases. Further, the ECU 36 decreases the engine speed of the engine 9 and the heat generation amount of the engine 9 thus decreases. The ECU 36 thus rapidly decreases the temperature rise rate of the engine 9 when overheating occurs. Further, the decrease of the engine speed of the engine 9 is performed not by misfiring but by adjustment of the opening degree of the throttle valve 54 or adjustment of the injection amount of fuel, and the uncombusted fuel that contacts the catalyst 60 is thus reduced. The degradation of the catalyst 60 is thus prevented.

Also in the first preferred embodiment, if the engine 9 is overheating, the ECU 36 judges whether or not the opening degree of the throttle valve 54 is not less than the threshold value. Then if the opening degree of the throttle valve 54 is not less than the threshold value, the ECU 36 decreases the rotational speed of the crankshaft 38 and sets the target air-fuel ratio to a value richer than the stoichiometric air-fuel ratio. In other words, if the opening degree of the throttle valve 54 is less than the threshold value, the ECU 36 does not perform the deceleration control of decreasing the engine speed of the engine 9 and the enrichment control of setting the target air-fuel ratio to the value richer than the stoichiometric air-fuel ratio.

When the opening degree of the throttle valve 54 is an idling opening degree (opening degree of the throttle valve 54 when the engine 9 is idling) or is in the vicinity of the idling opening degree, the heat generation amount of the engine 9 is low and, therefore, the temperature of the engine 9 decreases gradually even if the ECU 36 does not perform the deceleration control and the enrichment control. Therefore, by the ECU 36 performing the deceleration control and the enrichment control when the opening degree of the throttle valve 54 is not less than the threshold value, the temperature rise rate of the engine 9 is decreased rapidly and the control of the engine 9 is prevented from being complicated.

Also with the first preferred embodiment, the initial map M1 that is used when the engine 9 is not overheating is stored in the storage device 65 of the ECU 36. Further, the fixed value (the coefficient C) that changes the initial map M1 to the overheat map or the overheat map M2 is stored in the storage device 65 of the ECU 36.

In the case where the coefficient C1 that changes the initial map M1 to the overheat map is stored in the storage device 65, the engine 9 overheats, the ECU 36 changes all of the target air-fuel ratios of the initial map M1 uniformly to the values richer than the stoichiometric air-fuel ratio by multiplying all of the target air-fuel ratios of the initial map M1 by the coefficient C1 or by subtracting the coefficient C1 from all of the target air-fuel ratios of the initial map M1. The ECU 36 then uses the changed initial map M1 as the overheat map of the engine 9. The target air-fuel ratio is thus set to be richer than the stoichiometric air-fuel ratio and the temperature rise rate of the engine 9 decreases. Further, the coefficient C1 includes less data than the independent overheat map M2 and the storage device 65 is thus reduced in storage capacity in comparison to the case where both the initial map M1 and the overheat map M2 are stored in the storage device 65.

On the other hand, in the case where the overheat map M2, which is independent of the initial map M1, is stored in the storage device 65, the ECU 36 uses the target air-fuel ratios of the overheat map M2 when the engine 9 overheats. The plurality of target air-fuel ratios of the overheat map M2 respectively correspond to the plurality of target air-fuel ratios of the initial map M1. The plurality of target air-fuel ratios of the overheat map M2 are thus set according to the operation conditions of the engine 9. Further, each target air-fuel ratio of the overheat map M2 is set to a value that is richer than the corresponding target air-fuel ratio of the initial map M1 and richer than the stoichiometric air-fuel ratio. The ECU 36 thus makes the temperature rise rate of the engine 9 decrease by using the target air-fuel ratios of the overheat map M2. Further, the overheat map M2 is independent of the initial map M1 and the ECU 36 thus uses the overheat map M2 that has been set individually without dependence on the initial map M1.

Also with the first preferred embodiment, a portion of the exhaust passage 23 is made of a material that contains aluminum, which is an example of a light metal. The engine 9 is thus light in weight. On the other hand, aluminum is lower in heat resistance than iron and, therefore, the heat resistance of the exhaust passage 23 is lower than when the entire exhaust passage 23 is made of a material having iron as the main component. However, the temperature rise of the engine 9 is reduced as described above and, therefore, not only the engine 9 is light in weight but melting of a portion of the exhaust passage 23 is also prevented.

Also with the first preferred embodiment, the temperature of the outer wall of the engine 9 is preferably detected by the temperature detecting device 64. For example, the temperature of at least one of the cylinder body 40, cylinder head 41, and crankcase 42 is detected by the temperature detecting device 67. The temperature of the outer wall of the engine 9 changes when an abnormality occurs in the cooling device of the engine 9. The temperature of the outer wall of the engine 9 has a high sensitivity with respect to an abnormality of the cooling device. Especially when the engine 9 is made of a material that contains aluminum, which is higher in thermal conductivity than iron, the temperature of the outer wall of the engine 9 changes in a short time when an abnormality occurs in the cooling device. The ECU 36 judges whether or not the engine 9 is overheating based on the temperature of the outer wall of the engine 9. The time from occurrence of an abnormality in the cooling device to detection of the abnormality is thus shortened.

Also with the first preferred embodiment, the water inlet 28 opens underwater and the water inlet 28 may be clogged by underwater foreign matter, such as seaweed, etc. In this case, the cooling ability of the cooling device decreases temporarily and there is a possibility of the engine 9 overheating. Especially with the engine 9 that includes the catalyst 60, not only is heat generated by the reaction of the catalyst 60 and the exhaust but the exhaust temperature is also high because the target air-fuel ratio is set to the stoichiometric air-fuel ratio under many operation conditions.

However, as mentioned above, if the engine 9 is overheating, the ECU 36 not only makes the heat generation amount of the engine 9 decrease by decreasing the rotational speed but also makes the exhaust temperature decrease by changing the target air-fuel ratio. The temperature rise rate of the engine 9 is thus decreased and the temperature change of the engine 9 is made gradual. The maximum temperature attained by the engine 9 is thus lowered and the time for the temperature of the engine 9 to decrease below the overheating temperature is thus shortened.

Second Preferred Embodiment

Figure 7:
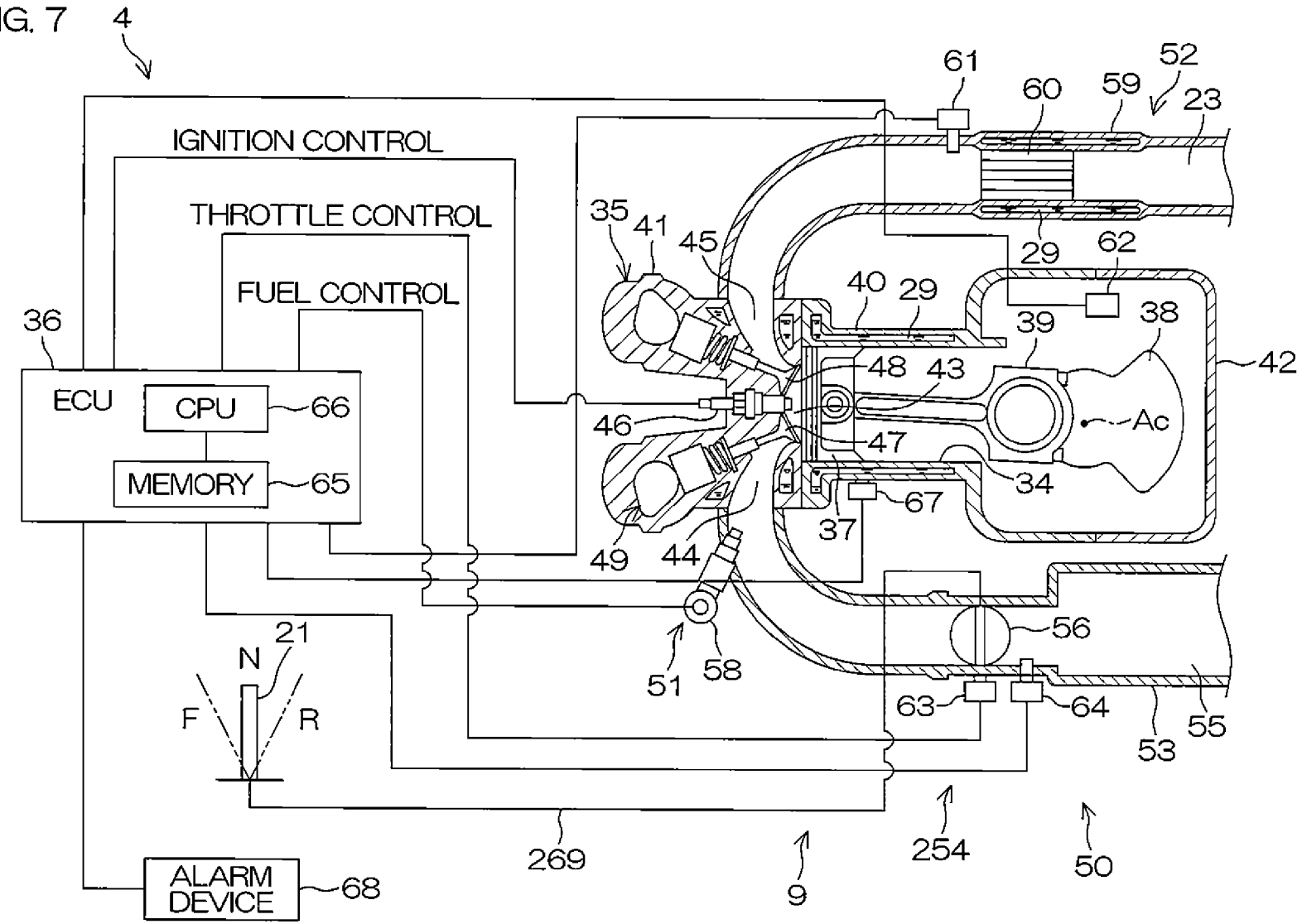
FIG. 7 is a schematic view of the general arrangement of an engine according to a second preferred embodiment of the present invention.
Figure 8:
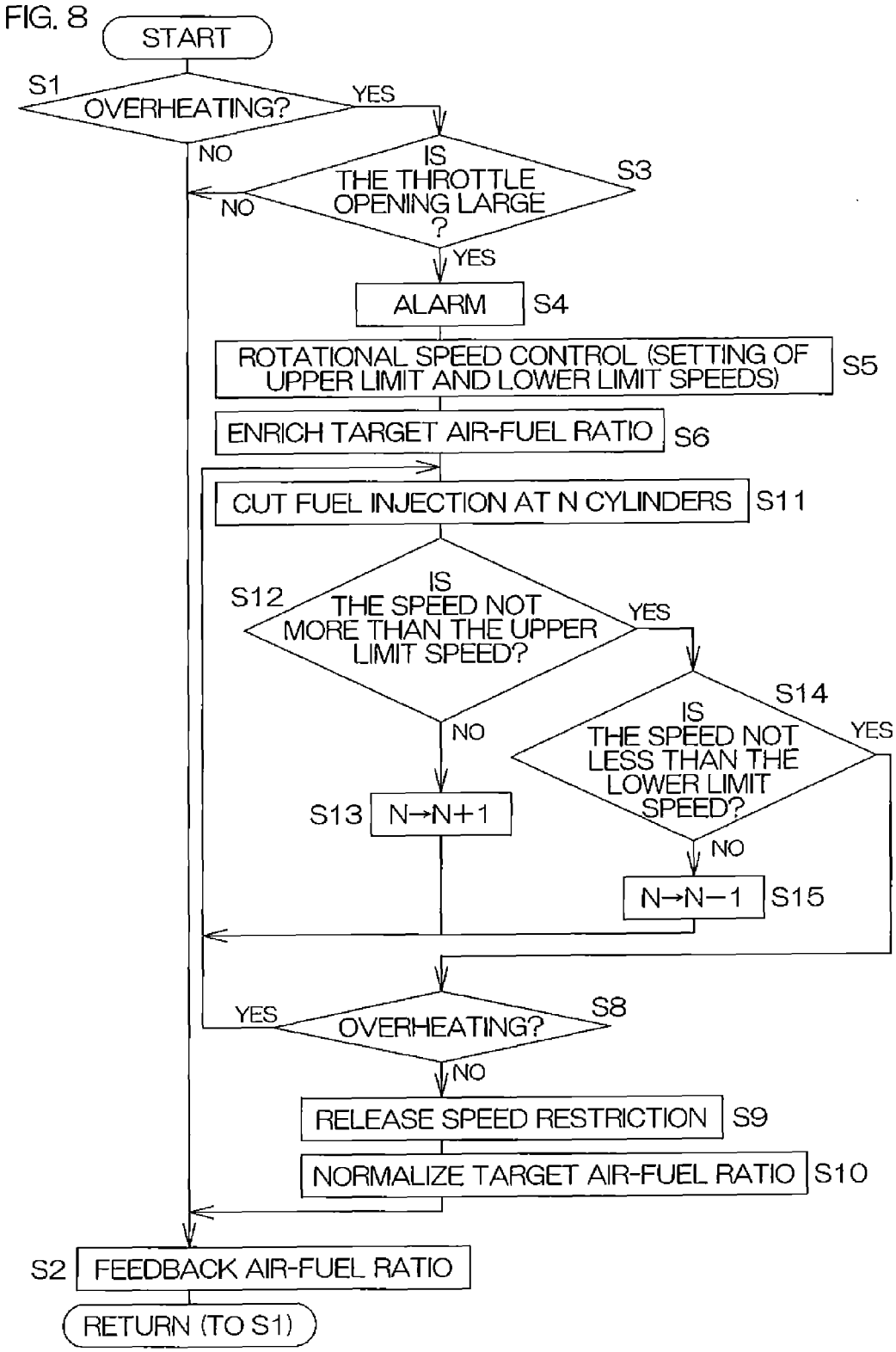
FIG. 8 is a flowchart of another example of a flow when the engine is overheating.

A second preferred embodiment of the present invention shall now be described. A principal point of difference between the second preferred embodiment and the first preferred embodiment is that mechanical throttle valves are used in place of the electronically controlled throttle valves. In FIG. 7 and FIG. 8, component portions equivalent to the respective portions shown in FIG. 1 to FIG. 6 in the above description are provided with the same reference symbols as those of FIG. 1, etc., and description thereof shall be omitted.

FIG. 7 is a schematic view of the general arrangement of the engine 9 according to the second preferred embodiment of the present invention. FIG. 8 is a flowchart of another example of a flow when the engine 9 is overheating. A portion of the flowchart of FIG. 8 is the same as that of the flowchart of FIG. 4 and, therefore, in regard to the flowchart of FIG. 8, portions differing from the flowchart of FIG. 4 shall mainly be described.

As shown in FIG. 7, the engine 9 includes mechanical throttle valves 254 in place of the electronically controlled throttle valves 54. Each throttle valve 254 is coupled to the remote control lever 21 by a wire 269. An operating force applied to the remote control lever 21 by the user is transmitted from the remote control lever 21 to the throttle valve 254 by the wire 269. The opening degree of the throttle valve 254 is thus adjusted by being linked to the movement of the remote control lever 21.

As shown in FIG. 8, if the engine 9 is overheating and the opening degree of the throttle valve 254 is not less than the threshold value (in the case of Yes in step S3), the ECU 36 notifies the occurrence of overheating to the vessel occupant by the alarm device 68 (step S4). Thereafter, the ECU 36 sets an upper limit speed and a lower limit speed of the engine speed of the engine 9 to decrease the engine speed of the engine 9 (step S5). Further, the ECU 36 changes the target air-fuel ratio to a value richer than the stoichiometric air-fuel ratio to increase the proportion of the fuel (step S6). In this process, the ECU 36 may use the factor C1 stored in the storage device 65 to change the initial map M1 to the overheat map as shown in FIG. 5A or may use the overheat map M2, which is separate from the initial map M1, as shown in FIG. 5B.

After changing the target air-fuel ratio to the value richer than the stoichiometric air-fuel ratio, the ECU 36 stops the supply of fuel to a portion of the plurality of cylinders 34 (step S11). Specifically, the ECU 36 stops the injection of fuel from N fuel injectors 58 corresponding to N cylinders 34 among the plurality of cylinders 34. "N" is a positive integer that changes in a range from 1 to (total number of the cylinders—1). For example, in the case of a four-cylinder internal combustion engine, in which the total number of the cylinders 34 is 4, N changes in a range from 1 to 3. The supply of fuel to a portion of the plurality of cylinders 34 is thus stopped. The engine speed of the engine 9 thus decreases.

After stopping the supply of fuel to the N cylinders 34, the ECU 36 judges whether or not the engine speed of the engine 9 exceeds the upper limit speed (step S12). If the engine speed of the engine 9 exceeds the upper limit speed (in the case of No in step S12), the ECU 36 increases the value of N by substituting the value of N up to now by (N+1) (step S13). The ECU 36 then increases the number of cylinders 34 to which the supply of fuel is stopped (return to step S11). The engine speed of the engine 9 thus decreases further. Thereafter, the ECU 36 judges again whether or not the engine speed of the engine 9 exceeds the upper limit speed (step S12).

If the engine speed of the engine 9 is not more than the upper limit speed (in the case of Yes in step S12), the ECU 36 judges whether or not the engine speed of the engine 9 is not less than the lower limit speed (step S14). If the engine speed of the engine 9 is less than the lower limit speed (in the case of No in step S14), the ECU 36 decreases the value of N by substituting the value of N up to now by (N−1) (step S15). The ECU 36 then decreases the number of cylinders 34 to which the supply of fuel is stopped (return to step S11). The engine speed of the engine 9 thus increases. Thereafter, the ECU 36 judges again whether or not the engine speed of the engine 9 is not less than the lower limit speed (step S14).

If the engine speed of the engine 9 is not less than the lower limit speed and not more than the upper limit speed (in the case of Yes in step S12 and step S14), the ECU 36 judges again whether or not the engine 9 is overheating (step S8). If the engine speed of the engine 9 exceeds the upper limit speed or is less than the lower limit speed (in the case of No in step S12 or step S14), the ECU 36 adjusts the engine speed of the engine 9 to be not less than the lower speed and not more than the upper limit speed and thereafter judges again whether or not the engine 9 is overheating (step S8). Therefore, while the engine 9 is overheating, the engine speed of the engine 9 is restricted within the range of not less than the lower limit speed and not more than the upper limit speed. For example, if the upper limit speed is 2600 rpm and the lower limit speed is 2500 rpm, the engine speed of the engine 9 is restricted within the range of 2500 rpm to 2600 rpm.

If the engine 9 is overheating (in the case of Yes in step S8), the ECU 36 continues the restriction of the engine speed of the engine 9 (returns to step S11). On the other hand, if the temperature of the engine 9 decreases to less than the overheating temperature (in the case of No in step S8), the ECU 36 releases the restriction of the engine speed of the engine 9 by the upper limit speed and the lower limit speed and ends the stoppage of fuel being supplied to the N cylinders (step S9). Thereafter, the ECU 36 returns the target air-fuel ratios to the original values (step S10). Then based on the detection value of the air-fuel ratio sensor 61, the ECU 36 calculates the air-fuel ratio of the air-fuel mixture actually supplied to the combustion chamber 43 to adjust the amount of fuel to be injected subsequently by the fuel injector 58 (step S2).

As described above, with the second preferred embodiment, if the engine 9 is overheating, the ECU 36 stops the injection of fuel from a portion of the plurality of fuel injectors 58. The supply of fuel to a portion of the plurality of combustion chambers 43 is thus stopped and the combustion of the air-fuel mixture in the portion of the combustion chambers 43 is stopped. The rotational speed of the crankshaft 38 thus decreases. Further, the ECU 36 sets the target air-fuel ratio of the air-fuel mixture supplied to the remaining combustion chamber(s) 43, to which the supply of fuel is not stopped, to the value richer than the stoichiometric air-fuel ratio. The temperature of the exhaust discharged from the remaining combustion chamber(s) 43 thus decreases. The ECU 36 thus rapidly decreases the temperature rise rate of the engine 9.

With the second preferred embodiment, if the engine 9 is overheating, the number of combustion chambers 43, to which the supply of fuel is stopped, is increased or decreased in accordance with the rotational speed of the crankshaft 38. Specifically, if the engine speed of the engine 9 decreases to less than the lower limit speed, the ECU 36 decreases the number of combustion chambers 43 to which the supply of fuel is stopped to increase the engine speed of the engine 9. Also, if the engine speed of the engine 9 exceeds the upper limit speed, the ECU 36 increases the number of combustion chambers 43 to which the supply of fuel is stopped to decrease the engine speed of the engine 9. The engine speed of the engine 9 is thus adjusted to be within a range of not less than the lower limit speed and not more than the upper limit speed. The ECU 36 thus rapidly decreases the temperature rise rate of the engine 9 while securing the minimum output of the engine 9.

Other Preferred Embodiments

Although first and second preferred embodiments of the present invention have been described above, the present invention is not restricted to the contents of the first and second preferred embodiments and various modifications are possible within the scope of the present invention.

For example, with the first and second preferred embodiments, cases where the engine 9 preferably is an outboard motor engine installed in an outboard motor were described. However, the engine 9 may instead be installed in an inboard motor, inboard/outboard motor, or other apparatus besides an outboard motor, for example.

Also with the first and second preferred embodiments, cases where the exhaust passage 23 is preferably made of a material containing aluminum, which is an example of a light metal lighter than iron, was described. However, the exhaust passage 23 may instead be made of a material having iron as a main component.

Also with the first and second preferred embodiments, cases where the temperature detecting device 67 detects the temperature of the outer wall of the engine 9 at the periphery of the cylinders 34 were described. However, the portion at which the temperature is detected by the temperature detecting device 67 does not have to be a portion at the periphery of the cylinders 34 as long as it is at a position at which the temperature changes in accordance with an abnormality of the cooling device.

Also with the first and second preferred embodiments, cases where the remote control lever 21 is disposed as the throttle operating member at the vessel operator compartment, which is provided in front of the stern, was described. However, the throttle operating member may be disposed at the stern instead. Specifically, in a case where the vessel propulsion apparatus 2 includes a tiller handle that transmits a steering force, applied by the user, to the outboard motor 4, a throttle grip may be provided as the throttle operating member at the tiller handle.

The present application corresponds to Japanese Patent Application No. 2013-035065 filed on Feb. 25, 2013 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An engine comprising:

a combustion chamber in which an air-fuel mixture of air and fuel is combusted;

a crankshaft which rotates in accordance with a combustion of the air-fuel mixture in the combustion chamber;

an intake passage which guides a gas toward the combustion chamber;

a throttle valve which changes a flow rate of the gas supplied from the intake passage to the combustion chamber;

a fuel injector which injects a fuel into the intake passage or into the combustion chamber;

an exhaust passage which guides exhaust discharged from the combustion chamber;

a catalyst disposed inside the exhaust passage;

a temperature detecting device which detects a temperature of the engine; and a controller programmed to judge whether or not the engine is overheating based on a detection value of the temperature detecting device and, if the engine is overheating, to control an opening degree of the throttle valve or an injection amount of fuel from the fuel injector to decrease a rotational speed of the crankshaft and to control the injection amount of fuel from the fuel injector to set a target air-fuel ratio to a value richer than a stoichiometric air-fuel ratio; wherein the controller includes a storage device that stores an initial map that includes a plurality of target air-fuel ratios, the plurality of target air-fuel ratios of the initial map are set according to operation conditions of the engine that include the rotational speed of the crankshaft; and if the engine is not overheating, the controller is programmed to use the plurality of target air-fuel ratios of the initial map, and if the engine is overheating, the controller is programmed to change all of the plurality of target air-fuel ratios of the initial map uniformly to values richer than the stoichiometric air-fuel ratio and to use the initial map after the change as an overheat map.

2. The engine according to claim 1, wherein, if the engine is overheating, the controller is programmed to change all of the plurality of target air-fuel ratios of the initial map by multiplying all of the plurality of target air-fuel ratios of the initial map by a fixed value stored in the storage device or by subtracting a fixed value stored in the storage device from all of the plurality of target air-fuel ratios of the initial map.

3. An engine comprising:

a combustion chamber in which an air-fuel mixture of air and fuel is combusted;

a crankshaft which rotates in accordance with a combustion of the air-fuel mixture in the combustion chamber;

an intake passage which guides a gas toward the combustion chamber;

a throttle valve which changes a flow rate of the gas supplied from the intake passage to the combustion chamber;

a fuel injector which injects a fuel into the intake passage or into the combustion chamber;

an exhaust passage which guides exhaust discharged from the combustion chamber;

a catalyst disposed inside the exhaust passage;

a temperature detecting device which detects a temperature of the engine; and a controller programmed to judge whether or not the engine is overheating based on a detection value of the temperature detecting device and, if the engine is overheating, to control an opening degree of the throttle valve or an injection amount of fuel from the fuel injector to decrease a rotational speed of the crankshaft and to control the injection amount of fuel from the fuel injector to set a target air-fuel ratio to a value richer than a stoichiometric air-fuel ratio; wherein the controller includes a storage device that stores an initial map that includes a plurality of target air-fuel ratios, the plurality of target air-fuel ratios of the initial map are set according to operation conditions of the engine that include the rotational speed of the crankshaft;

the storage device further stores an overheat map that includes a plurality of target air-fuel ratios corresponding to the plurality of target air-fuel ratios of the initial map, each target air-fuel ratio of the overheat map is set to a value that is richer than the corresponding target air-fuel ratio of the initial map and richer than the stoichiometric air-fuel ratio; and the controller is programmed to use the plurality of target air-fuel ratios of the initial map if the engine is not overheating, and to use the plurality of target air-fuel ratios of the overheat map if the engine is overheating.

4. The engine according to claim 1, wherein, if the engine is overheating, the controller is programmed to judge whether or not the opening degree of the throttle valve is not less than a threshold value and, if the opening degree of the throttle valve is not less than the threshold value, to decrease the rotational speed of the crankshaft and to change all of the plurality of target air-fuel ratios of the initial map uniformly to values richer than the stoichiometric air-fuel ratio and to use the initial map after the change as the overheat map.

5. The engine according to claim 3, wherein, if the engine is overheating, the controller is programmed to judge whether or not the opening degree of the throttle valve is not less than a threshold value and, if the opening degree of the throttle valve is not less than the threshold value, to decrease the rotational speed of the crankshaft and to use the plurality of target air-fuel ratios of the overheat map.

6. The engine according to claim 1, wherein the throttle valve is an electronically controlled throttle valve, the opening degree of the electronically controlled throttle valve is adjusted by the controller, and if the engine is overheating, the controller is programmed to decrease the opening degree of the throttle valve to decrease the rotational speed of the crankshaft and to change all of the plurality of target air-fuel ratios of the initial map uniformly to values richer than the stoichiometric air-fuel ratio and to use the initial map after the change as the overheat map.

7. The engine according to claim 3, wherein the throttle valve is an electronically controlled throttle valve, the opening degree of the electronically controlled throttle valve is adjusted by the controller, and if the engine is overheating, the controller is programmed to decrease the opening degree of the throttle valve to decrease the rotational speed of the crankshaft and to use the plurality of target air-fuel ratios of the overheat map.

8. The engine according to claim 1, wherein the throttle valve is a mechanical throttle valve, the opening degree of the mechanical throttle valve is adjusted by an operating force applied to a throttle operating member by a user and transmitted from the throttle operating member to the mechanical throttle valve;

the engine includes a plurality of the combustion chambers and a plurality of the fuel injectors, corresponding to the plurality of combustion chambers, arranged to inject fuel to be supplied to the plurality of combustion chambers; and if the engine is overheating, the controller is programmed to stop an injection of fuel from a portion of the plurality of fuel injectors to stop a supply of fuel to a portion of the plurality of combustion chambers to decrease the rotational speed of the crankshaft and to change all of the plurality of target air-fuel ratios of the initial map uniformly to values richer than the stoichiometric air-fuel ratio and to use the initial map after the change as the overheat map such that the air-fuel mixture supplied to a remaining portion of the plurality of combustion chambers, to which the supply of fuel is not stopped, is richer than the stoichiometric air-fuel ratio.

9. The engine according to claim 8, wherein the controller is programmed to increase or decrease a number of combustion chambers to which the supply of fuel is stopped in accordance with the rotational speed of the crankshaft.

10. The engine according to claim 3, wherein the throttle valve is a mechanical throttle valve, the opening degree of the mechanical throttle valve is adjusted by an operating force applied to a throttle operating member by a user and transmitted from the throttle operating member to the mechanical throttle valve;

the engine includes a plurality of the combustion chambers and a plurality of the fuel injectors, corresponding to the plurality of combustion chambers, arranged to inject fuel to be supplied to the plurality of combustion chambers; and if the engine is overheating, the controller is programmed to stop an injection of fuel from a portion of the plurality of fuel injectors to stop a supply of fuel to a portion of the plurality of combustion chambers to decrease the rotational speed of the crankshaft and to use the plurality of target air-fuel ratios of the overheat map such that the air-fuel mixture supplied to a remaining portion of the plurality of combustion chambers, to which the supply of fuel is not stopped, is richer than the stoichiometric air-fuel ratio.

11. The engine according to claim 10, wherein the controller is programmed to increase or decrease a number of combustion chambers to which the supply of fuel is stopped in accordance with the rotational speed of the crankshaft.

12. The engine according to claim 1, wherein at least a portion of the exhaust passage is made of a material that contains aluminum.

13. The engine according to claim 3, wherein at least a portion of the exhaust passage is made of a material that contains aluminum.

14. The engine according to claim 1, wherein the temperature detecting device is a device that detects the temperature of an outer wall of the engine.

15. The engine according to claim 3, wherein the temperature detecting device is a device that detects the temperature of an outer wall of the engine.

16. An outboard motor comprising:

the engine according to claim 1;

an engine supporting member supporting the engine such that a rotational axis of the crankshaft extends in an up/down direction;

a driveshaft extending in the up/down direction below the engine and driven to rotate by the engine;

a propeller shaft, to which a power transmitted from the engine to the driveshaft is transmitted and which rotates together with a propeller;

a cooling water passage covering at least a portion of the catalyst; and a water pump driven by the engine to take in water outside the outboard motor from a water inlet that opens underwater and to supply the water to the cooling water passage.

17. An outboard motor comprising:

the engine according to claim 3;

an engine supporting member supporting the engine such that a rotational axis of the crankshaft extends in an up/down direction;

a driveshaft extending in the up/down direction below the engine and driven to rotate by the engine;

a propeller shaft, to which a power transmitted from the engine to the driveshaft is transmitted and which rotates together with a propeller;

a cooling water passage covering at least a portion of the catalyst; and a water pump driven by the engine to take in water outside the outboard motor from a water inlet that opens underwater and to supply the water to the cooling water passage.

* * * * *